US012714279B2

(12) United States Patent
Protz et al.

(10) Patent No.: US 12,714,279 B2
(45) Date of Patent: Aug. 25, 2026

(54) HAND-GUIDED FLOOR CLEANING MACHINE WITH A SUCTION FOOT MOUNT

(71) Applicant: Hako GmbH, Bad Oldesloe (DE)

(72) Inventors: Carsten Protz, Altenkrempe (DE); Bertram Ulrich, Lübeck (DE)

(73) Assignee: Hako GmbH, Bad Oldesloe (DE)

( * ) Notice: Subject to any disclaimer, the term of this patent is extended or adjusted under 35 U.S.C. 154(b) by 382 days.

(21) Appl. No.: 18/143,921

(22) Filed: May 5, 2023

(65) Prior Publication Data

US 2023/0363608 A1 Nov. 16, 2023

(30) Foreign Application Priority Data

May 10, 2022 (DE) ..... DE1020221117200

(51) Int. Cl.
*A47L 11/40* (2006.01)
*A47L 11/08* (2006.01)
*A47L 11/30* (2006.01)

(52) U.S. Cl.
CPC ..... *A47L 11/4055* (2013.01); *A47L 11/085* (2013.01); *A47L 11/4025* (2013.01);
(Continued)

(58) Field of Classification Search
CPC . A47L 11/4044; A47L 7/0009; A47L 11/4055
See application file for complete search history.

(56) References Cited

U.S. PATENT DOCUMENTS 3,065,490 A * 11/1962 Arones ..... A47L 11/4061 15/401
3,663,985 A * 5/1972 Burgoon ..... A47L 11/4025 15/353

(Continued)

FOREIGN PATENT DOCUMENTS

CN 113576354 A 11/2021
CN 215605454 U 1/2022

(Continued)

OTHER PUBLICATIONS

European Search Report mailed Oct. 2, 2021 for corresponding European Application No. 23172059.0, filed May 8, 2023.

(Continued)

*Primary Examiner* — Bryan R Muller
(74) *Attorney, Agent, or Firm* — REISING ETHINGTON, P.C.

(57) ABSTRACT

A hand-guided floor cleaning machine with a base, a driven brush element that is configured to engage with a floor surface in a cleaning plane, a fluid applicator for applying cleaning liquid to the floor surface, and a suction foot that is secured via a mount on the base and configured to receive dirty liquid from the floor surface. The mount has a first pivoting arm, which is articulated on the base with the machine end so as to be pivotable about a first pivot axis which runs parallel to a cleaning plane, a guide wheel, which is coupled to the first pivoting arm, and a second pivoting arm, which is articulated on the first pivoting arm so as to be pivotable about a second pivot axis which runs parallel to the first pivot axis. The suction foot is attached to a distal end of the second pivoting arm.

8 Claims, 6 Drawing Sheets

Figure 1:
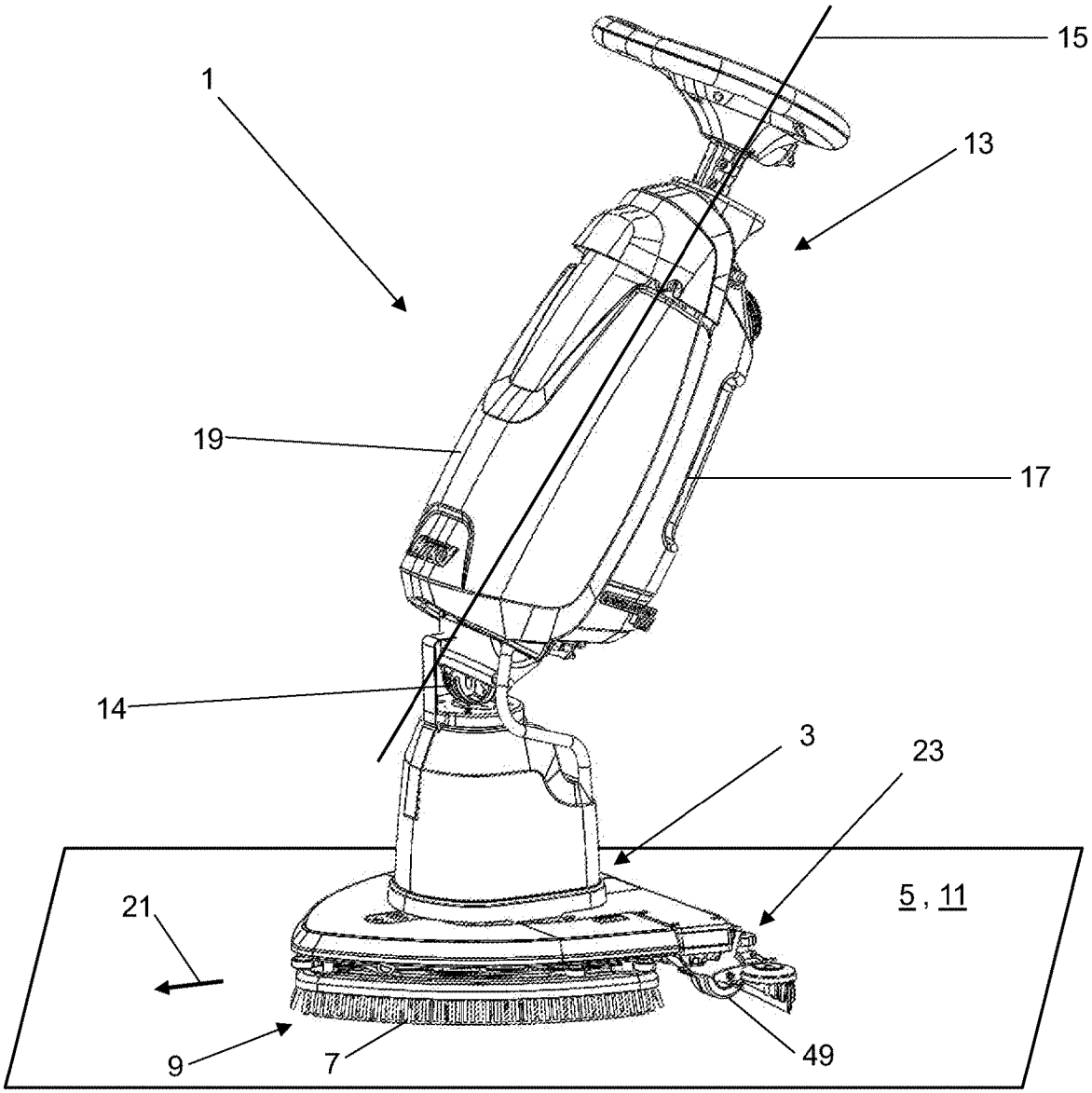

(52) U.S. Cl.
CPC ..... *A47L 11/4044* (2013.01); *A47L 11/4091* (2013.01); *A47L 11/305* (2013.01); *A47L 11/4083* (2013.01)

(56) References Cited

U.S. PATENT DOCUMENTS

| | | | | |
|---|---|---|---|---|
| 3,824,645 | A * | 7/1974 | Krier | E01H 1/103 15/83 |
| 4,339,841 | A | 7/1982 | Waldhauser | |
| 4,363,152 | A | 12/1982 | Karpanty | |
| 5,623,743 | A | 4/1997 | Burgoon et al. | |
| 6,295,682 | B1 * | 10/2001 | Klucznik | A47L 11/4055 15/49.1 |
| 7,287,299 | B2 * | 10/2007 | Joynt | A47L 11/30 15/340.1 |
| 2003/0000549 | A1 * | 1/2003 | Joynt | A47L 11/4055 15/49.1 |
| 2004/0074028 | A1 * | 4/2004 | Goff | A47L 11/4016 15/50.2 |
| 2005/0193519 | A1 | 9/2005 | Joynt | |
| 2011/0107540 | A1 * | 5/2011 | Shinler | A47L 11/40 15/245 |
| 2016/0353958 | A1 * | 12/2016 | Vetse | A47L 11/4055 |
| 2024/0415356 | A1 * | 12/2024 | Putt | A47L 7/0004 |

FOREIGN PATENT DOCUMENTS

| | | | | |
|---|---|---|---|---|
| EP | 2080468 | A2 | 7/2009 | |
| EP | 4257025 | A2 * | 10/2023 | A47L 11/4075 |
| FR | 1329253 | A | 6/1963 | |
| WO | WO2009127836 | A1 | 10/2009 | |

OTHER PUBLICATIONS

Chinese Office Action and Search Report for Chinese Application No. 202310513905.8 dated Jul. 10, 2025 (8 pages).

* cited by examiner

HAND-GUIDED FLOOR CLEANING MACHINE WITH A SUCTION FOOT MOUNT

CROSS-REFERENCE TO RELATED APPLICATIONS

This application claims the benefit and priority of German Patent Application No. 10 2022 111 720.0, filed May 10, 2022, the disclosure of which is incorporated by reference as if fully set forth in detail herein.

FIELD

The present disclosure relates to a hand-guided floor cleaning machine with a suction foot mount.

BACKGROUND

Floor cleaning machines of this type are known from the prior art. Here, a cleaning device is provided on a base, which cleaning device has one or more driven brush elements which are configured to engage with the floor surface to be cleaned and to release dirt from it in the process. An operating handle is attached pivotably to the base, and the floor cleaning machine which is supported substantially by the brush elements with respect to the floor surface to be cleaned can be guided by way of the operating handle, and the orientation of the base can be adjusted. Furthermore, an application device is provided, by way of which cleaning liquid is moved into the region of the brush elements, with the result that the releasing of dirt is improved. Furthermore, a suction foot which is connected to a dirty liquid container in the base or the operating handle is articulated directly on the base. By way of the suction foot, dirty liquid can be removed again from the bottom surface to be cleaned by way of a vacuum which can be generated in the dirty liquid container by way of an extraction device.

It has proven problematic in floor cleaning machines of this type that the base is supported only by way of the driven brush elements on the floor surface to be cleaned and, as a result, the movement direction, along which the floor cleaning machine moves, changes slightly, which can be the case solely as a result of the fact that the brush elements engage with different strengths with the floor surface to be cleaned. It can therefore be appropriate to provide guide wheels on the base, which guide wheels likewise lie on the floor surface to be cleaned. Here, however, the vertical position of the guide wheels has to be readjusted in a manner which is dependent on the wear of the brush elements, which is laborious, and, on account of the contact of the suction foot with the floor surface to be cleaned, the guide wheels should not be lifted up from this floor surface either.

Moreover, it also has to be ensured that the suction foot lies reliably on the floor surface to be cleaned, in order that dirty liquid is extracted reliably. Moreover, machines of this type should be configured in such a way that there is a transport position, in which neither the brush elements nor the suction foot lie on the floor surface and the machine can nevertheless be moved over the latter by means of wheels, in order to enable transport of the machine, in the case of which there is no risk that the brush elements and/or the suction foot are/is damaged.

SUMMARY

This section provides a general summary of the disclosure, and is not a comprehensive disclosure of its full scope or all of its features.

Proceeding from the prior art, it is therefore the object of the present disclosure to provide a hand-guided floor cleaning machine of the type mentioned at the outset, in the case of which the guide wheels are moved reliably into contact with the floor surface to be cleaned, the suction foot lying reliably on the floor surface to be cleaned, independently of the former.

This object can be achieved by way of a hand-guided floor cleaning machine for cleaning a floor surface with a base, on which a cleaning device is provided which has at least one driven brush element which is configured to engage in a cleaning plane with a floor surface to be cleaned and to support the base with respect to the floor surface, and with an operating handle which is secured pivotably on the base and extends away from the base, an application device for applying cleaning liquid to the floor surface to be cleaned being provided on the base, a suction foot being secured via a mount on the base and being configured to receive dirty liquid from the floor surface to be cleaned, the mount having a first pivoting arm which extends between a machine end and a free end and is articulated on the base with the machine end so as to be pivotable about a first pivot axis which runs parallel to the cleaning plane, the mount having a guide wheel which is attached to the first pivoting arm between the machine end and the free end, the mount having a second pivoting arm which extends between a proximal end and a distal end and is articulated on the first pivoting arm between the machine end and the free end so as to be pivotable about a second pivot axis which runs parallel to the first pivot axis, and the suction foot being attached to the distal end of the second pivoting arm.

In the case of the floor cleaning machine according to the disclosure, one or more mounts are therefore provided on the base, on which the cleaning device is provided with the brush elements which support the base, which one or more mounts first of all have a first pivoting arm, on the region of which, which is remote from the base, a guide wheel is attached, it being possible for the pivoting arm to be pivoted with respect to the base. As a result, it is achieved that the guide wheel always lies on the floor surface to be cleaned independently of the height of the brush elements.

In one preferred embodiment, a prestressing device can be provided here which prestresses the first pivoting arm in such a way that its free end is pressed towards the cleaning plane, in which the free ends of the brush elements are situated. As a result, the guide wheels are pressed against the floor surface to be cleaned. In particular, the prestressing device can have a spring which is arranged between the base and the first pivoting arm.

In some examples, a second pivoting arm is articulated pivotably on the first pivoting arm of the one or plurality of mounts, which second pivoting arm in turn holds the suction foot. On account of the pivoting capability of the second pivoting arm with respect to the first pivoting arm, the vertical position of the suction foot relative to the guide wheels can change. Moreover, the pivotable second pivoting arm of the one or plurality of holders makes it possible that the suction foot, even if the guide wheels lie on the floor surface to be cleaned, is pivoted upwards away from this floor surface into a transport position, in which the suction foot no longer lies on the floor surface. The floor cleaning machine can then be moved over a floor surface by means of the guide wheels, without the suction foot lying on this floor surface and without it being possible for this suction foot to be damaged.

In a preferred way, the suction foot is configured in such a way that the suction foot has a suction foot base, to which a front suction lip and a rear suction lip are attached which extend, for example parallel to one another, away from the suction foot base and which are spaced apart from one another in such a way that an extraction space is delimited by the suction lips and the suction foot base, those edges of the suction lips which are remote from the suction foot base extending in a contact plane and being configured to lie on the floor surface to be cleaned, and the distal end of the second pivoting arm being fastened to the suction foot base. By way of a construction of this type of the suction foot, dirty liquid can be removed reliably from a floor surface to be cleaned if the extraction space which can be connected to a dirty liquid container of the floor cleaning machine is loaded with vacuum.

In a further preferred way, the suction foot can have a guide element, for example in the form of a sliding element or a wheel, which is provided to lie on the floor surface to be cleaned, and which, as a result, fixes the vertical position of the suction foot relative to the floor surface to be cleaned and prevents the entire load of the suction foot having to be supported by the suction lips. This guide element can be provided centrally on the suction foot.

Furthermore, it is preferred if the stop is provided on the first of the second pivoting arm, the stop being configured to limit the pivoting movement of the first pivoting arm relative to the second pivoting arm away from the base. As a result, it is prevented that the suction foot can pivot too far down below the level which is defined by the contact surface of the one or plurality of guide wheels.

In a further preferred embodiment, a locking arrangement is provided which has a first latch element which is connected to the suction foot base and the second latch element which is attached to the base of the first pivoting arm, the first and the second latch element being configured and attached in such a way that they can be brought releasably into engagement in a transport position, in which the suction foot is pivoted away from the cleaning plane, with the result that the suction foot is prevented from carrying out a pivoting movement towards the cleaning plane. In this way, it is possible that, when it is pivoted away from the floor surface, the suction foot is locked in this transport position, in order to prevent it from spontaneously pivoting back. In a particularly preferred way, the first latch element can be configured as a lever which is attached movably on the suction foot and is prestressed into a locking position, the first latch element engaging with the second latch element when the suction foot is in the transport position and the first latch element is in the locking position, and it being possible for the first latch element to be released from the second latch element by way of a movement counter to the prestress. A mechanism of this type can be operated simply.

Furthermore, it is preferred that it is possible for the suction foot to be pivoted by way of pivoting of the second pivoting arm into a transport position, in which the suction foot is pivoted away from the cleaning plane, it being possible for the first pivoting arm to be pivoted with respect to the base between a pivoted-up and a pivoted-down position. The free end is closer to the cleaning plane in the pivoted-down position than in the pivoted-up position, the first and the second pivoting arm being coupled to one another in such a way that the first pivoting arm is pivoted into the pivoted-up position when the suction foot is pivoted into the transport position by way of pivoting of the second pivoting arm. A coupling of the movement of the second pivoting arm to that of the first pivoting arm can be achieved, which can position the first pivoting arm closest to the base when the second pivoting arm is pivoted into the transport position. As a result, the suction foot is moved in the vertical direction into the highest position when it is in the transport position, with the result that structures which are situated on the upper side of the suction foot cannot come into contact with the brush elements or the base. Moreover, the guide wheels are then fixed, and the vertical position cannot change during a transport journey.

In order to realise this, it is preferred, furthermore, if a coupling element is provided, the coupling element being articulated on the base so as to be pivotable about a first axis which runs parallel to the first pivot axis, the coupling element being attached to the second pivoting arm on a side of the second pivot axis which faces away from the suction foot, so as to be pivotable about a second axis which runs parallel to the second pivot axis and so as to be displaceable over a limited displacement range, and the displacement range being configured in such a way that, when the suction foot is pivoted towards the transport position, an end of the displacement range is reached before the transport position is reached. In this way, the coupling element brings it about that, after the end of the displacement range is reached, further pivoting of the second pivoting arm always also has to be linked to pivoting of the first pivoting arm. As a result, when the second pivoting arm and therefore the suction foot are pivoted towards the transport position, the first pivoting arm is also pivoted, to be precise into the pivoting position close to the base.

In a further preferred embodiment, the operating handle is connected pivotably to the base by way of a joint, it being possible for a locking mechanism to be adjusted between a locking position and a release position, the operating handle being locked non-pivotably in a transport position with respect the base when the locking mechanism is in the locking position, and it being possible for the operating handle to be pivoted with respect to the base when the locking mechanism is in the release position. In this embodiment, the operating handle can be locked in a certain position relative to the base, such as in a position where the longitudinal axis of the operating handle extends perpendicularly with respect to the cleaning plane. The base can then be pivoted away from the floor surface by way of pivoting of the operating handle, it being possible for this pivoting movement to take place around the guide wheels. This makes it possible that the floor cleaning machine is tilted in such a way that it is then pulled over the floor surface by means of the guide wheels for transport purposes. In one preferred embodiment, the hand-guided floor cleaning machine can be provided with a cleaning liquid container which is connected to the application device, with a dirty liquid container which is connected to the suction foot, and with an extraction device which is configured to apply a vacuum to the dirty liquid container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
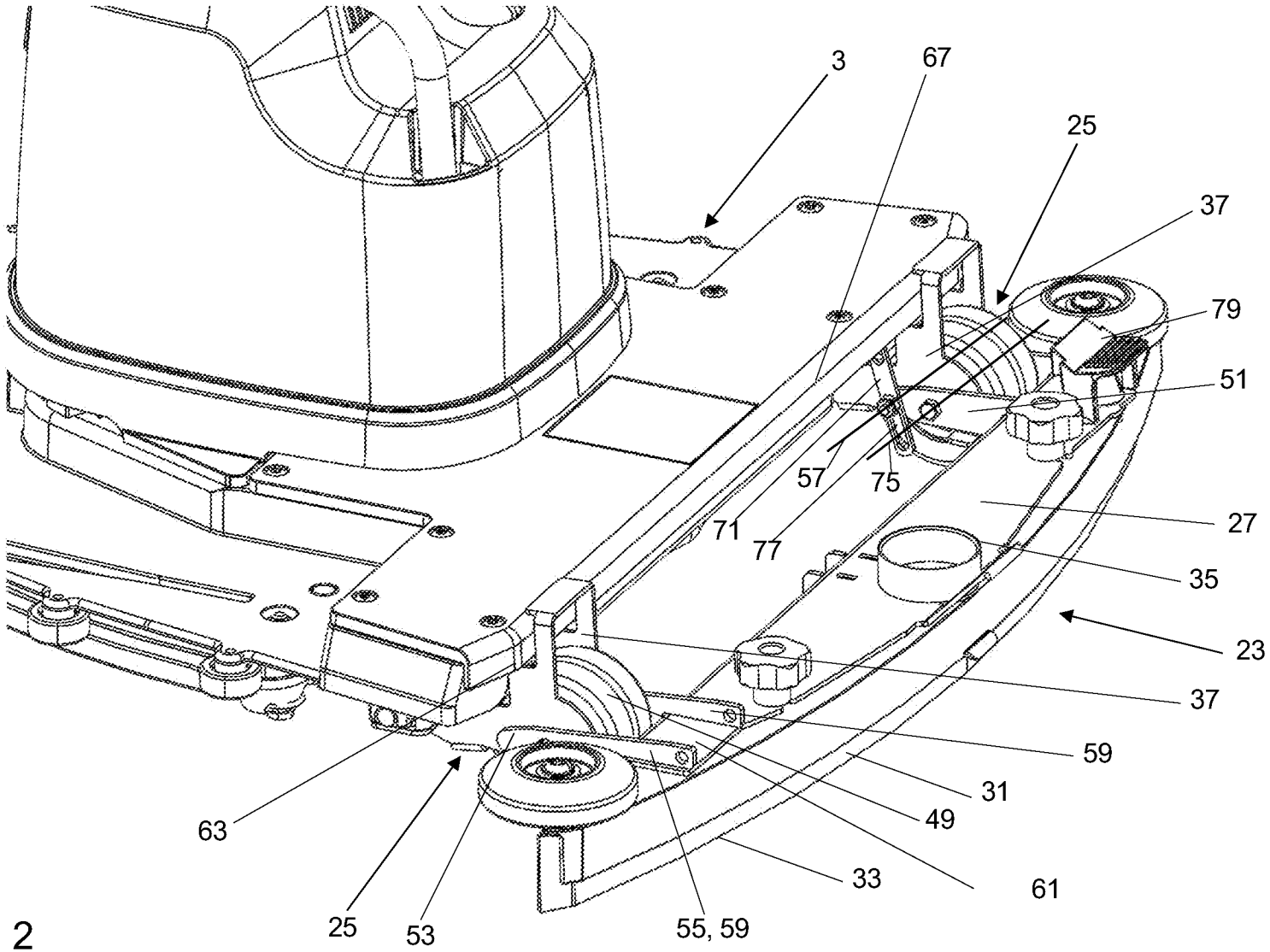
Figure 3:
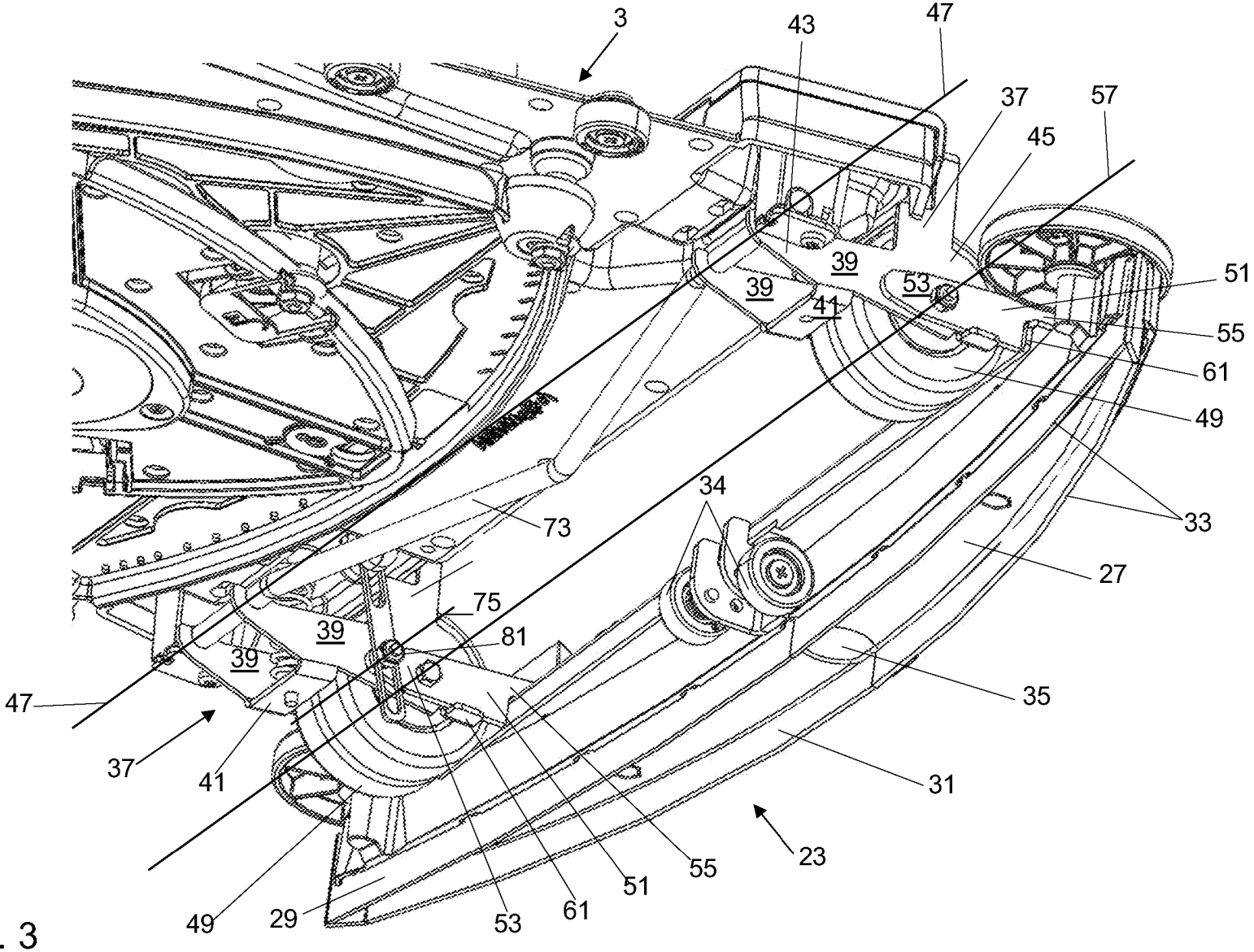
Figure 4:
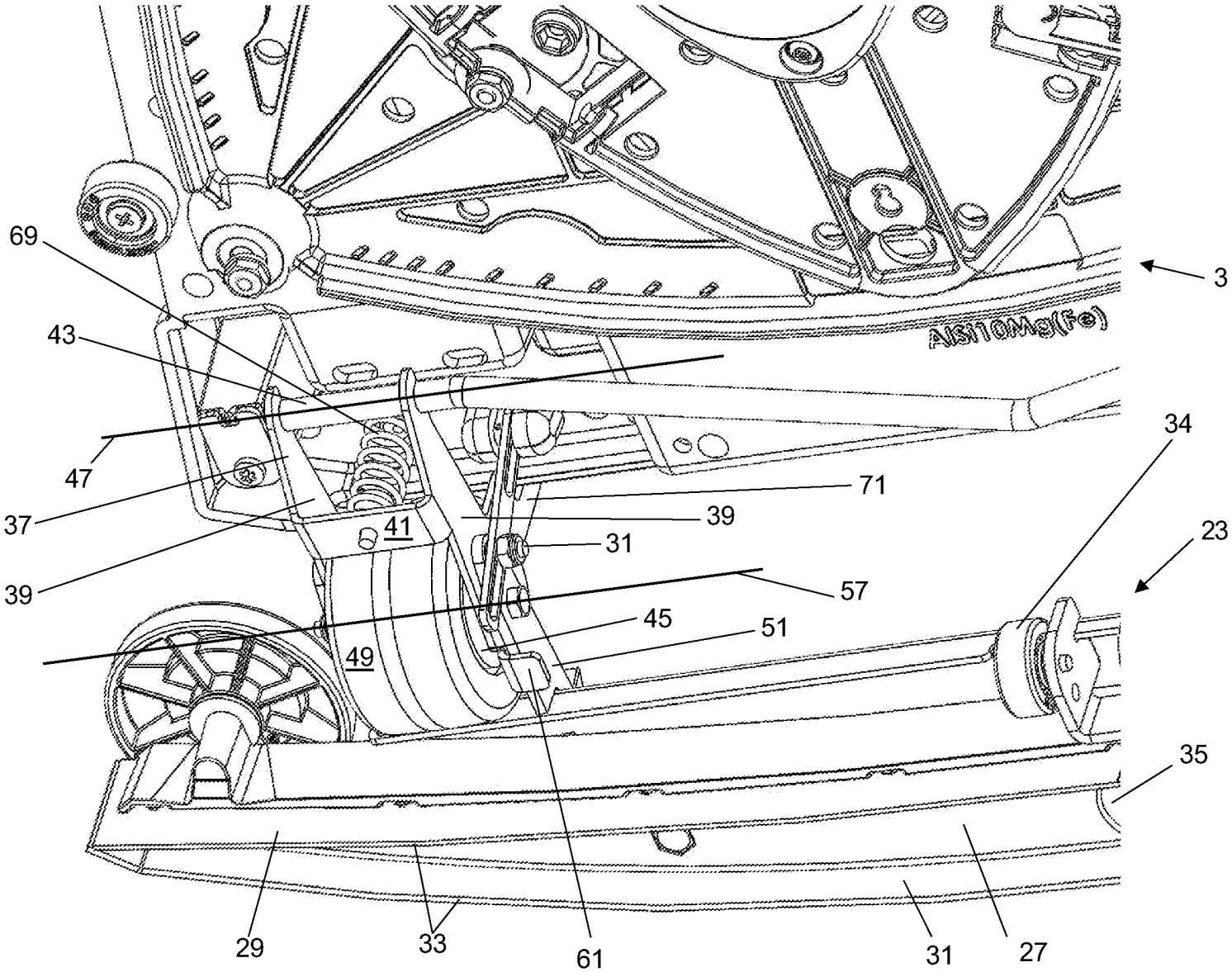
Figure 5:
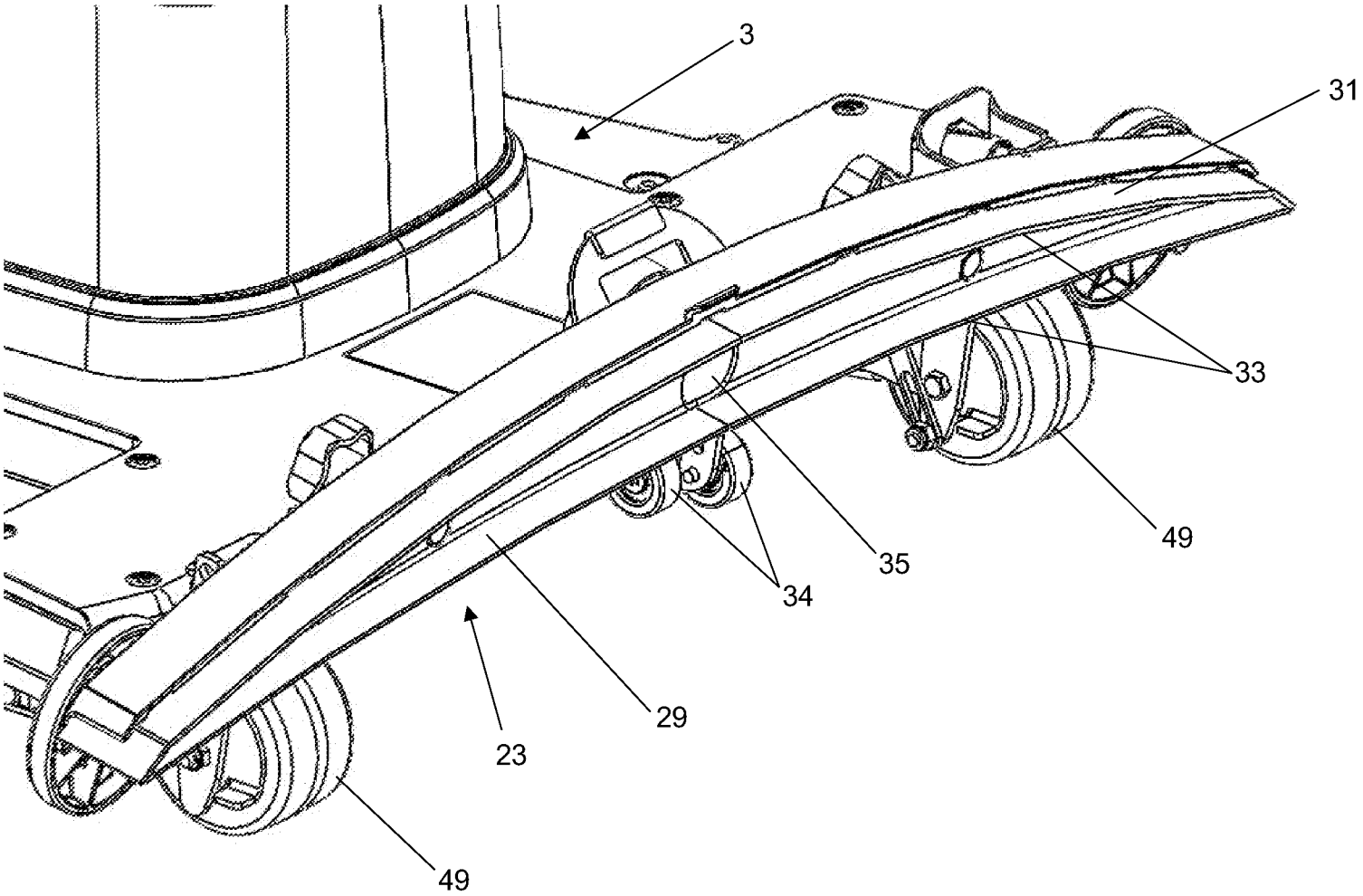
Figure 6:
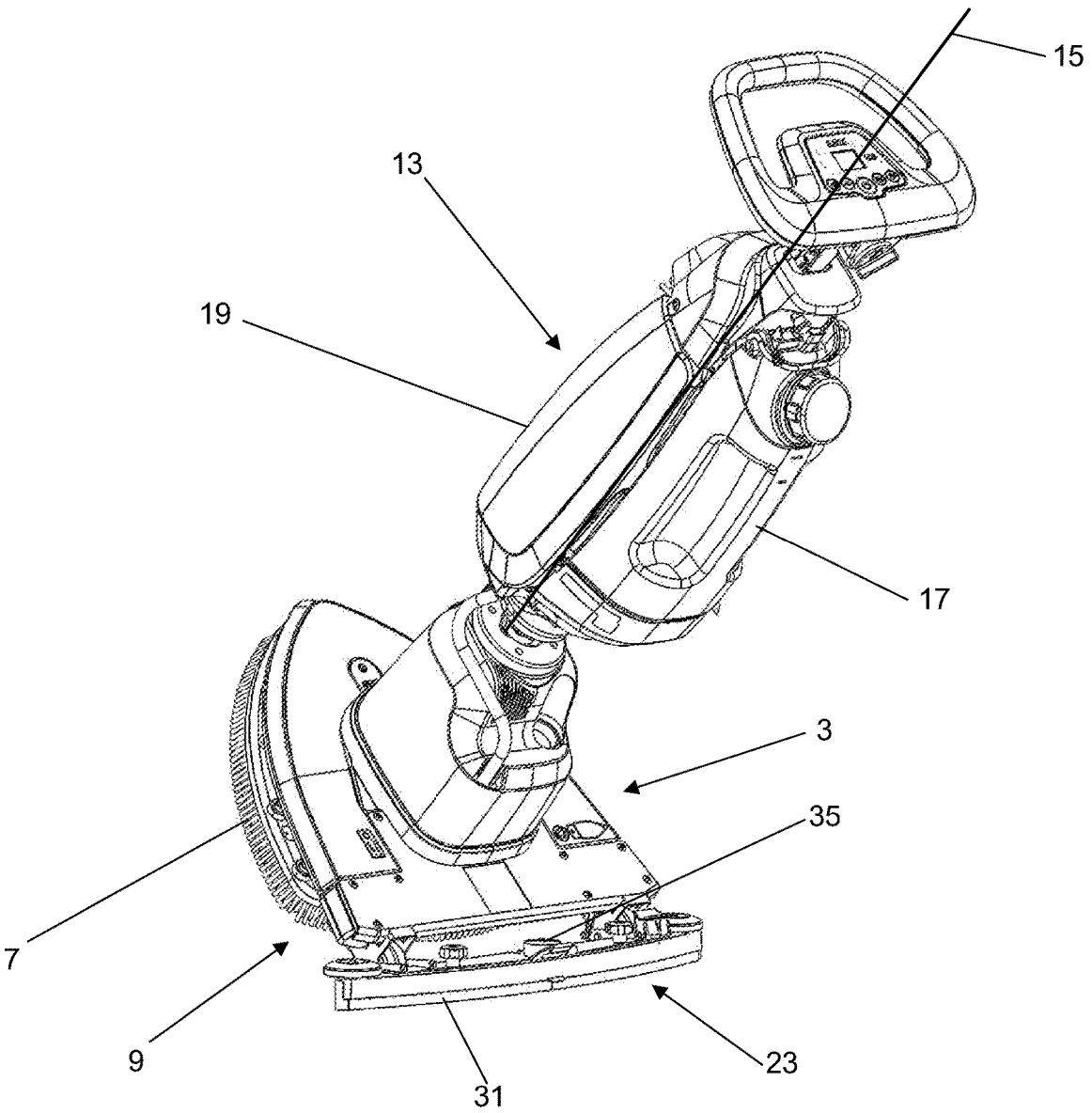

FIG. 1 shows one exemplary embodiment of a hand-guided floor cleaning machine according to the disclosure in a perspective illustration, FIG. 2 shows a perspective view of the rear portion of the base of the floor cleaning machine with the suction foot from FIG. 1, FIG. 3 shows a perspective view from below of the lower portion of the base of the floor cleaning machine from FIG. 1, FIG. 4 shows the suction foot and the base of the exemplary embodiment from FIG. 1 from below in perspective, FIG. 5 perspectively shows the rear part of the base and the suction foot of the floor cleaning machine from FIG. 1, the suction foot being in the transport position, and FIG. 6 shows the floor cleaning machine from FIG. 1 in a rearwardly pivoted position.

Corresponding reference numerals indicate corresponding parts throughout the several views of the drawings.

DETAILED DESCRIPTION

As is apparent from FIG. 1, the exemplary embodiment of a hand-guided floor cleaning machine 1 according to the present disclosure has a base 3 which is configured to be guided over a floor surface 5 to be cleaned, a cleaning device 9 which, in the preferred exemplary embodiment which is described here, has two brush elements 7 which each perform an orbital movement being provided on the base 3. The cleaning device 9 or the brush elements 7 move parallel to a cleaning plane 11, in which the free ends of the bristles of the brush elements 7 are arranged and in which they engage with the floor surface 5 to be cleaned. Moreover, the cleaning device 9 has an application device, for example in the form of nozzles, by way of which cleaning liquid can be applied to the floor surface 5 to be cleaned, this taking place in such a way that the cleaning liquid passes into the region, in which the brush elements 7 come into contact with the floor surface 5 to be cleaned. Here, the base 3 is supported by brush elements 7 on the floor surface 5.

Furthermore, it can be gathered from FIG. 1, in particular, that an operating handle 13 with a grip for guiding the machine 1 is attached pivotably to the base 3, the operating handle 13 and the base 3 being connected via a joint 14, and that this operating handle 13 is configured in such a way that it has a locking mechanism which can be adjusted between a locking position and a release position. In the exemplary embodiment which is described here, a transport position of the floor cleaning machine 1 is selected in such a way that the operating handle 13 is then arranged with its longitudinal axis 15 substantially perpendicularly with respect to the cleaning plane 11, that is to say the operating handle 13 extends perpendicularly with respect to a floor surface 5 to be cleaned when the floor cleaning machine 1 is arranged with the brush elements 7 on the floor surface 5 to be cleaned. In this transport position, the locking mechanism can be moved into the locking position, and the operating handle 13 is then locked non-pivotably with respect to the base 3. When the locking mechanism is moved into the release position, the above-described locking action is released, and the operating handle 13 can be pivoted freely over a predefined angular range with respect to the base 3.

Furthermore, it can be gathered from FIG. 1 that a cleaning liquid container 17 and a dirty liquid container 19 are secured on the operating handle 13. The cleaning liquid container 17 is connected to the application device, with the result that, during operation of the floor cleaning machine 1, the latter can be supplied with cleaning liquid from the cleaning liquid container 17.

As can be gathered from the figures, furthermore, a suction foot 23 is attached via two mounts 25 in the preferred exemplary embodiment described here to a rear end of the base 3, as viewed in the normal movement direction 21.

The suction foot 23 comprises a suction foot base 27, from which a front suction lip 29 and a rear suction lip 31 extend away downwards substantially parallel to one another, the suction lips 29, 31 extending along the suction foot base 27, and those edges 33 of the suction lips 27, 29 which are remote from the suction foot base 27 being attached in a common contact plane, with the result that the edges 33 can together lie on the floor surface 5 to be cleaned. In the exemplary embodiment which is described here, the suction foot 23 additionally has a guide element in the form of two wheels 34 which are provided to lie on the floor surface 5 to be cleaned, such that, as a result, the vertical position of the suction foot 23 relative to the floor surface 5 to be cleaned is fixed, and it is prevented that the entire load of the suction foot 23 has to be supported by the suction lips 29, 31 on the floor surface 5 to be cleaned. The wheels 34 are arranged centrally on the suction foot 23. In this context, however, it is also to be noted that, as an alternative to the wheels 34, the guide element can also be configured as a sliding element.

An extraction space is formed between the suction lips 29, 31 and the suction foot base 27, which extraction space can be connected via a connector 35 and a suction line (not shown in the figures) to the dirty liquid container 19. The dirty liquid container 19 is in turn connected to a vacuum source, with the result that the extraction space is loaded with vacuum by the suction line, and an air flow can be generated from the extraction space into the dirty liquid container 19. In this way, dirty liquid which is situated on the floor surface 5 to be cleaned can be conveyed into the dirty liquid container 19.

Furthermore, it can be gathered from FIGS. 2 to 4, in particular, that each of the mounts 25, via which the suction foot 23 is secured on the base 3, has a first pivoting arm 37 which, in the exemplary embodiment which is described here, has two limbs 39 which are connected to one another via a connecting portion 41, the first pivoting arm 37 extending between a machine and 43 and the free end 45, and being articulated on the base 3 with the machine end 43 so as to be pivotable about a first pivot axis 47. Here, the first pivot axis 47 runs parallel to the cleaning plane 11, in which the brush elements 7 engage with the floor surface 5 to be cleaned.

In the case of each of the mounts 25, a guide wheel 49 is secured rotatably between the limbs 39 of the first pivoting arms 37.

As can be gathered, furthermore, from FIG. 3, in particular, a second pivoting arm 51 is provided away from the machine end 43 on each of the first pivoting arms 37, which second pivoting arm 51 extends between the proximal end 53 and a distal end 55, the second pivoting arm 51 being articulated on the first pivoting arm 37 so as to be pivotable about a second pivot axis 57. Here, the first and the second pivot axis 47, 57 run parallel to one another and therefore parallel to the cleaning plane 11. The suction foot base 27 is attached fixedly to the distal end 55 of the second pivoting arms 51. As can otherwise be gathered from FIG. 2, the second pivoting arms 51 likewise have two limbs 59 which are connected to one another via a connecting portion 61, the guide wheel 49 being arranged in each case between the limbs 59.

It can be seen, in particular, in FIGS. 3 and 4 that a stop 61 which extends away laterally is provided on a limb 39 of the first pivoting arms 37, with which stop 61 a limb 59 of the second pivoting arm 51 can come into contact, with the result that the pivoting range of the second pivoting arm 51 relative to the first pivoting arm 37 is limited downwards by way of the stop 61.

The first pivoting arms 37 can be pivoted about the first pivot axis 47 over a limited pivoting range, this pivoting range being limited upwards by way of bearing faces 63 on the limbs 39, it being possible for the bearing faces 63 to come into contact with the projection 67 on the base 3.

Furthermore, it can be seen in FIG. 3 and, in particular, in FIG. 4 that one of the mounts 25 has a prestressing element in the form of a spring 69 which is arranged between the connecting portion 41 of the first pivoting arm 37 and the base 3, with the result that the first pivoting arm 37 is prestressed in such a way that its free end 45 is pressed towards the cleaning plane 11. It is also possible, however, that the two mounts 25 have a spring 69 which is attached in this way.

Furthermore, it can be seen in FIGS. 2 and 3 that one of the mounts 25 additionally has a coupling element 71 which is articulated on the base 3 so as to be pivotable about a first axis 73. An end, remote from the first axis 73, of the coupling element 71 is connected to the second pivoting arm 51 so as to be pivotable about a second axis 75, and can additionally be displaced with respect to the second pivoting arm 51 over a displacement range defined by a slot 77, the coupling element 71 being attached on that side of the second pivot axis 57 which faces away from the suction foot 23 to the second pivoting arm 51, that is to say to the proximal end 53. The first and the second axis 73, 75 run parallel to one another and parallel to the pivot axes 47, 57. A coupling element 71 of this type can also be provided on the two mounts 25.

Finally, it can be seen in FIG. 2, in particular, that a first latch element in the form of a pivotable lever 79 which is attached to the suction foot base 27 is provided on the suction foot base 27, which lever 79 is spring-prestressed into the position shown in FIG. 2, with the result that it can be pivoted to the right out of the position shown in FIG. 2 only counter to a force. When the suction foot 23, as shown in FIG. 5, is pivoted upward about a second pivot axis 57 into a transport position, the first latch element in the form of the lever 79, after it has been deflected counter to the action of the spring prestress, can engage behind that portion of the first pivoting arm 37, on which the bearing face 63 is provided and which forms the second latch element, with the result that the suction foot 23 can be locked in the transport position shown in FIG. 5 by way of the engagement of the latch elements.

During the pivoting of the suction foot 23 about the second pivot axis 57 towards the transport position, the pin 81 which is received in the slot 79 of the coupling element 71 is displaced until it comes into contact with the end of the slot 79 and therefore reaches the end of the displacement range, in which the coupling element 71 can be displaced with respect to the second pivoting arm 51. This is the case before the transport position is reached. If the pin 81 has arrived at the end of the slot and the suction foot 23 or the second pivoting arm 51 is pivoted further, this has the effect that, on account of the coupling element 71, the first pivoting arm 37 is pivoted upwards away from the cleaning plane 7 counter to the action of the spring 69. It is achieved as a result that, in the transport position, the first pivoting arm 37 is in the pivoting position which is closest to the base 3, as a result of which it is avoided that the connector 35 on the suction foot base 27 comes into contact with the base 3.

Moreover, the coupling element 71 serves to prevent the first pivoting arm 37 from pivoting downwards away from the base 3 to an unlimited extent. This is because, when the pin 81 has reached the lower end of the slot 79, the first pivoting arm 73 cannot pivot further downwards and away on account of the contact of the second pivoting arm 51 with the stop 61.

On account of the mounts 25 which are configured in the particular example illustrated, the floor cleaning machine 1 with the suction foot 23 can be operated in the following way.

In normal cleaning operation, the suction foot 23 lies on the floor surface 5 to be cleaned, in order to receive dirty liquid from it, while the floor cleaning machine 1 is pushed by a user over the floor surface 5 to be cleaned. Here, the spring 69 ensures that the guide wheels 49 always lie on the floor surface 5 to be cleaned, independently of the extent to which the brush element 7 are worn or how far they extend downwards away from the base 3. By virtue of the fact that the guide wheels 49 reliably bear against the floor surface 5 to be cleaned, a rectilinear movement of the base 3 along the movement direction 21 is possible without problems.

Moreover, the suction foot 23 can vertically avoid obstacles on account of the pivoting capability of the second pivoting arms 51 and, moreover, bears reliably against the floor surface 5 to be cleaned, this additionally being ensured here by way of the wheels 34.

If a user merely wishes to remove dirty liquid from the floor surface 5 to be cleaned, they can lock the operating handle 13 with the aid of the locking mechanism in the position shown in FIG. 6 with respect to the base 3, and can subsequently pivot the base 3 away from the floor surface 5 to be cleaned, this pivoting movement taking place about the rotational axes, about which the guide wheels 49 rotate.

Finally, it is also possible that a user first of all pivots the suction foot 23 into the transport position in the way which has already been described, the suction foot 23 being locked there on account of the engagement of the lever 79 with a further latch element, and then likewise pivoting the base 3 away from the floor surface 5 to be cleaned when the operating handle 13 is locked. Neither the brush elements 7 nor the suction foot 23 then lie on the floor surface, and the floor cleaning machine 1 can be transported without the risk of these elements being damaged.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

| List of Reference Signs | |
|---|---|
| 1 | Cleaning machine |
| 3 | Base |
| 5 | Floor surface to be cleaned |
| 7 | Brush elements |
| 9 | Cleaning device |
| 11 | Cleaning plane |

-continued

| List of Reference Signs | |
|---|---|
| 13 | Operating handle |
| 14 | Joint |
| 15 | Longitudinal axis |
| 17 | Cleaning liquid container |
| 19 | Dirty liquid container |
| 21 | Movement direction |
| 23 | Suction foot |
| 25 | Mount |
| 27 | Suction foot base |
| 29 | Front suction lip |
| 31 | Rear suction lip |
| 33 | Edge, suction lip |
| 34 | Wheel |
| 35 | Connector |
| 37 | First pivoting arm |
| 39 | Limb, first pivoting arm |
| 41 | Connecting portion |
| 43 | Machine end |
| 45 | Free end |
| 47 | First pivot axis |
| 49 | Guide wheel |
| 51 | Second pivoting arm |
| 53 | Proximal end |
| 55 | Distal end |
| 57 | Second pivot axis |
| 59 | Limb, second pivoting arm |
| 61 | Stop |
| 63 | Bearing faces |
| 67 | Projection |
| 69 | Spring |
| 71 | Coupling element |
| 73 | First axis |
| 75 | Second axis |
| 77 | Slot |
| 79 | Lever |
| 81 | Pin |

What is claimed is:

1. A hand-guided floor cleaning machine for cleaning a floor surface with a base configured to apply cleaning liquid to the floor surface to be cleaned, on which a cleaning device is provided which has at least one driven brush element which is configured to engage in a cleaning plane with a floor surface to be cleaned and to support the base with respect to the floor surface, and with an operating handle which is secured pivotably on the base and extends away from the base, a suction foot being secured via a mount on the base and being configured to receive dirty liquid from the floor surface to be cleaned, the mount having a first pivoting arm which extends between a machine end and a free end and is articulated on the base with the machine end so as to be pivotable about a first pivot axis which runs parallel to the cleaning plane, the mount having a guide wheel which is attached to the first pivoting arm between the machine end and the free end, the mount having a second pivoting arm which extends between a proximal end and a distal end and is articulated on the first pivoting arm between the machine end and the free end so as to be pivotable about a second pivot axis which runs parallel to the first pivot axis, and the suction foot being attached to the distal end of the second pivoting arm wherein the suction foot is configured to be pivoted into a transport position, in which the suction foot is pivoted away from the cleaning plane, and a coupling being articulated on the base so as to be pivotable about a first axis which runs parallel to the first pivot axis, the coupling element being attached to the second pivoting arm on a side of the second pivot axis, which faces away from the suction foot, so that the second pivoting arm is pivotable about the second axis, which runs parallel to the first pivot axis, over a limited displacement range, and the coupling element and second pivoting arm being configured in such a way that, when the suction foot is pivoted towards the transport position, an end of the displacement range of the second pivoting arm is reached before a transport position is reached, and the first pivoting arm is pivoted into a pivoted-up position when the suction foot is pivoted the remainder of the way into the transport position, by way of pivoting of the second pivoting arm.

2. The hand-guided floor cleaning machine according to claim 1, the suction foot having a suction foot base, to which a front suction lip and a rear suction lip are attached which extend, away from the suction foot base and are spaced apart from one another in such a way that an extraction space is delimited by the suction lips and the suction foot base, edges of the suction lips which are remote from the suction foot base extending in a contact plane and being configured to lie on the floor surface to be cleaned, and the distal end of the second pivoting arm being fastened to the suction foot base.

3. The hand-guided floor cleaning machine according to claim 1, a spring being provided which is configured to prestress the first pivoting arm in such a way that the free end is pressed towards the cleaning plane.

4. The hand-guided floor cleaning machine according to claim 3, the spring being arranged between the base and the first pivoting arm.

5. The hand-guided floor cleaning machine according to claim 1, a locking arrangement being provided which has a first latch element which is connected to the suction foot base and a second latch element which is attached to the base or the first pivoting arm, the first and the second latch element being configured and attached in such a way that they can be brought releasably into engagement in a transport position, in which the suction foot is pivoted away from the cleaning plane, with the result that the suction foot is prevented from carrying out a pivoting movement towards the cleaning plane.

6. The hand-guided floor cleaning machine according to claim 5, the first latch element being configured as a lever which is attached movably to the suction foot and is prestressed into a locking position, the first latch element engaging with the second latch element when the suction foot is in the transport position and the first latch element is in the locking position, and configured to be released from the second latch element by way of a movement counter to the prestress.

7. The hand-guided floor cleaning machine according to claim 1, wherein the first pivoting arm is configured to be pivoted with respect to the base between the pivoted-up and a pivoted-down position, the free end being closer to the cleaning plane in the pivoted-down position than in the pivoted-up position.

8. The hand-guided floor cleaning machine according to claim 1, with a cleaning liquid container which is connected to the application device, with a dirty liquid container which is connected to the suction foot, such that the hand-guided floor cleaning machine is configured to apply a vacuum to the dirty liquid container.

* * * * *